US009702259B2

(12) United States Patent
Azalbert et al.

(10) Patent No.: US 9,702,259 B2
(45) Date of Patent: Jul. 11, 2017

(54) TURBOMACHINE COMPRESSOR GUIDE VANES ASSEMBLY

(71) Applicant: SNECMA, Paris (FR)

(72) Inventors: Roland Azalbert, Moissy-Cramayel (FR); Nicolas Claude Herve Lafond, Moissy-Cramayel (FR); Damien Guilmet, Moissy-Cramayel (FR)

(73) Assignee: SNECMA, Paris (FR)

( * ) Notice: Subject to any disclaimer, the term of this patent is extended or adjusted under 35 U.S.C. 154(b) by 358 days.

(21) Appl. No.: 14/364,475

(22) PCT Filed: Dec. 19, 2012

(86) PCT No.: PCT/FR2012/052991

§ 371 (c)(1),
(2) Date: Jun. 11, 2014

(87) PCT Pub. No.: WO2013/093337

PCT Pub. Date: Jun. 27, 2013

(65) Prior Publication Data

US 2014/0301841 A1 Oct. 9, 2014

(30) Foreign Application Priority Data

Dec. 19, 2011 (FR) ..... 11 61911

(51) Int. Cl.
*F01D 9/04* (2006.01)
*F01D 25/24* (2006.01)
(Continued)

(52) U.S. Cl.
CPC ..... *F01D 9/04* (2013.01); *F01D 25/246* (2013.01); *F04D 29/542* (2013.01); *F04D 29/668* (2013.01); *F05D 2260/30* (2013.01)

(58) Field of Classification Search
CPC ..... F01D 9/00; F01D 9/02; F01D 9/04; F01D 9/041; F01D 9/042
(Continued)

(56) References Cited

U.S. PATENT DOCUMENTS 2,833,514 A * 5/1958 Kahn ..... F01D 9/042 415/115
3,262,677 A * 7/1966 Bobo ..... F01D 9/02 415/139
(Continued)

FOREIGN PATENT DOCUMENTS

DE 10 2009 037 620 2/2011
EP 1 318 276 6/2003
(Continued)

OTHER PUBLICATIONS

International Search Report Issued Apr. 25, 2013 in PCT/FR12/052991 Filed Dec. 19, 2012.

*Primary Examiner* — Richard Edgar
(74) *Attorney, Agent, or Firm* — Oblon, McClelland, Maier & Neustadt, L.L.P.

(57) ABSTRACT

A sectorized turbomachine compressor guide vanes assembly includes assembled sectors forming two concentric shell rings, one outer and one inner, between which vanes are arranged with their leading and trailing edges near transverse faces of the shell rings, and of which an outer shell ring externally includes an attachment mechanism to an external casing that houses the sectors. The attachment mechanism is axially offset from the rear transverse face of the shell ring to be located, in projection, in alignment with the vanes between the leading and trailing edges thereof.

5 Claims, 2 Drawing Sheets

(51) Int. Cl.
*F04D 29/54* (2006.01)
*F04D 29/66* (2006.01)

(58) Field of Classification Search
USPC ..... 415/209.2, 209.4
See application file for complete search history.

(56) References Cited

U.S. PATENT DOCUMENTS

| | | | | |
|---|---|---|---|---|
| 3,302,926 | A | 2/1967 | Bobo | |
| 5,333,995 | A * | 8/1994 | Jacobs | F01D 25/246 415/173.1 |
| 6,425,738 | B1 * | 7/2002 | Shaw | F01D 9/041 415/208.1 |
| 2003/0102670 | A1 | 6/2003 | Seydel et al. | |
| 2004/0028529 | A1 | 2/2004 | Austin et al. | |
| 2007/0172349 | A1 * | 7/2007 | Abgrall | F01D 9/041 415/191 |
| 2012/0141253 | A1 | 6/2012 | Weidmann | |

FOREIGN PATENT DOCUMENTS

| | | |
|---|---|---|
| EP | 1 811 131 | 7/2007 |
| GB | 2 084 261 | 4/1982 |
| GB | 2 388 875 | 11/2003 |
| WO | 96 28642 | 9/1996 |
| WO | 2011 157956 | 12/2011 |

* cited by examiner

TURBOMACHINE COMPRESSOR GUIDE VANES ASSEMBLY

BACKGROUND OF THE INVENTION

Field of the Invention

The present invention relates to guide vane assemblies for compressors, in particular high-pressure compressors, designed for turbomachines, such as turbojet engines for aircraft.

Description of the Related Art

Generally, compressors for turbojet engines comprise a plurality of successive stages aligned along the longitudinal axis of the engine and made up alternately of movable stages forming the rotor of the compressor, the vane assemblies of which accelerate the gas flow by deflecting it relative to said axis, and fixed stages forming the stator, the vane assemblies of which partly transform the speed of the flow under pressure and guide said flow towards the following movable stage.

The final stage or stages of the stator of the high-pressure compressor are sectorised guide vane assemblies which principally, after successive assembly of the sectors one after the other in an external housing casing, form two concentric shell rings, one outer and one inner, between which are arranged the vanes of the vane assembly through which the gas flow, at that stage the primary gas flow, passes in a dual-flow turboshaft engine. The outer shell ring is provided with means of attachment such as the peripheral engagement rims (of curved form), referred to as front and rear according to the direction of the flow, for connecting the external casing of the stator of the compressor, whereas the inner shell ring has abradable devices on its outside connected with sealing devices for the rotor concerned.

In a turbojet engine, guide vane assemblies are parts that work statically (aerodynamic forces and mechanical forces passing through the external casing) as well as dynamically (for example, in relation to significant vibrations during transitory engine operation phases), and their dimensions are therefore defined in advance using a Haig curve which can determine their mechanical strength and resistance to fatigue.

Using this curve, the maximum admissible dynamic stress at a point on the part in question is therefore determined for a given static stress at that point. In addition, it is known from experience that the greatest possible maximum dynamic stress is required so as to be able to tolerate greater vibratory responses on the engine.

In the case of conventional fixed guide vane assemblies, the area of maximum static stress and the area of dynamic stress are located at the same place on the guide vane assembly, that is, at the rear of the cylindrical outer shell ring formed by the assembled sectors. Therefore, the admissible dynamic stress is greatly reduced because the maximum static stress is located at the same place, which limits the operating possibilities of the guide vane assembly and its resistance to fatigue, in particular at sustained vibratory engine speeds.

Patent FR 2 945 331 by the applicant discloses a solution for optimising dynamic stress, said solution consisting of drilling a horseshoe-shaped hole in the cylindrical wall of the upper shell ring, between the rear rim and the trailing edge of at least some of the vanes which are welded to the wall, so as to make the shell ring more "flexible" locally. This allows the static stresses in the blend radius of the curved rear rim to be considerably reduced so as to increase the maximum dynamic stress and push up the fatigue limit of the guide vane assembly in dynamic operation.

Although a solution of this type is permissible when there is enough space between the trailing edge of the vanes and the rear peripheral rim of the outer shell ring to drill the hole there, if this space is insufficient, the solution is not possible as it would require the hole to also be drilled through the rear rim in order to pass through the wall of the shell ring. Such a solution would weaken the guide vane assembly too much and would therefore be unsuitable for this type of guide vane assembly.

BRIEF SUMMARY OF THE INVENTION

The object of the present invention is to overcome this drawback.

Accordingly, the sectorised compressor guide vane assembly for a turbomachine is of the type comprising assembled sectors that form two concentric shell rings, one inner and one outer, between which vanes are arranged with their leading and trailing edges close to the front and rear transverse faces respectively of the shell rings in relation to the gas flow circulating in the compressor, the outer shell ring of which is externally provided with means of attachment to an external casing for housing said sectors.

According to the invention, such a guide vane assembly is noteworthy in that said means of attachment comprise the features according to one embodiment of the disclosure.

Therefore, by axially offsetting the means of attachment perpendicular to the vanes, the static stress, that is to say the aerodynamic forces and the stresses of the casing, is no longer concentrated and situated at the rear or downstream portion of the outer shell ring, but in the region of the vanes, and is therefore dissociated from the dynamic stress which is still located in the region of the rear portion of the outer shell ring of the guide vane assembly. In dissociating theses stresses, which are no longer superimposed, by offsetting the means of attachment of the shell ring relative to the casing, the rear portion of the outer shell ring is subject to less load as it is thus freed from the static stress and is now only subject to the dynamic stress. Consequently, this rear portion can work with an increased maximum admissible dynamic stress and therefore at higher vibratory engine speeds without the risk of damage thereto. In this way, the vibratory capacity of the guide vane assembly, in other words its ability to resist a given aerodynamic excitation, is improved.

Said means of attachment to the external casing comprises, in relation to the direction of the flow passing through the vanes, a front peripheral rim situated at the upstream front transverse face of the outer shell ring of said sectors, and a rear peripheral rim offset from the downstream transverse face of the outer shell ring, and situated projecting between the leading and trailing edges of the vanes.

Advantageously, said offset rear peripheral rim is situated projecting substantially at the centre of the vanes, between the leading and trailing edges thereof. Thus, the static stress is not only offset from the rear of the shell ring but is also reduced because the material volume, in which the forces causing the static stress transit between the rear rim, the shell ring and the vanes, is greater, the thickness of the vanes being greatest in that place.

In another embodiment, said means of attachment to the external casing comprise an annular flange provided on the periphery of the outer shell ring and situated projecting between the leading and trailing edges of the vanes. The results in terms of dissociating the stresses are similar to the previous embodiment, the rear of the outer shell ring being no longer subject to static stress.

Preferably, said attachment flange is situated projecting in the centre of the leading and trailing edges of the vanes, producing the same advantage as before in terms of reducing the static stress by increasing the material volume.

In particular, said rear peripheral rim or said flange can extend continuously or discontinuously over all the sectors.

BRIEF DESCRIPTION OF THE SEVERAL VIEWS OF THE DRAWINGS

The figures in the accompanying drawing will show clearly how the invention can be produced. In these figures, the same reference numerals refer to similar elements.

DETAILED DESCRIPTION OF THE INVENTION

Figure 1:
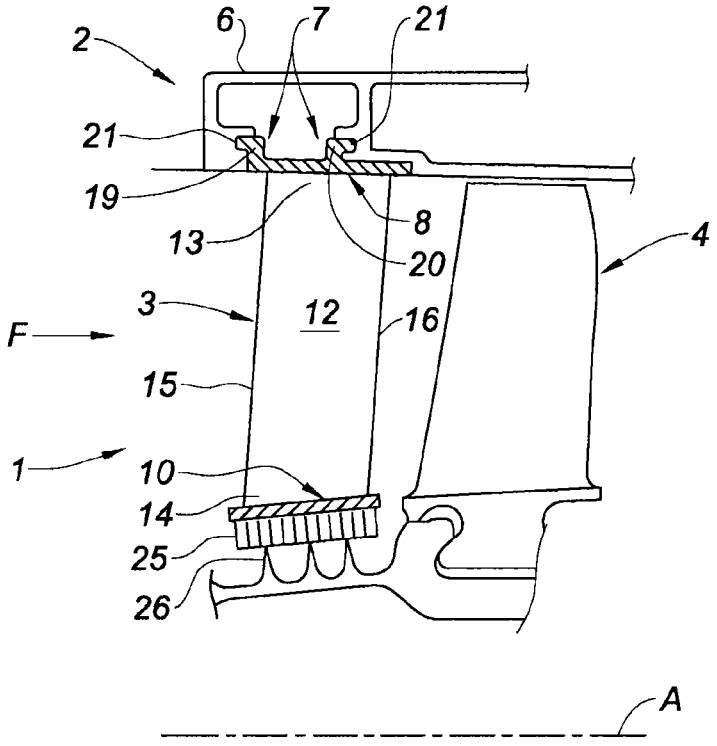
FIG. 1 shows, in diagrammatic longitudinal cross-section, a portion of a high-pressure compressor of a turbomachine, with a stator stage having a fixed guide vane assembly according to the invention followed by a rotor stage.

The compressor portion 1 shown in FIG. 1 is a portion of a high-pressure compressor of an aircraft turbojet engine with axis A, and it shows a stator stage 2 forming the fixed guide vane assembly 3, downstream of which a rotor stage 4 of said compressor is found. Conventionally, the stator guide vane assembly 3 is sectorised, in other words made up of a plurality of sectors 5 mounted successively one after the other in an annular external casing 6 for housing these sectors and holding them in position by means of attachment or engagement 7 to thus form the guide vane assembly in its entirety.

A single sector 5 is illustrated in the figures and in the description below, reference will be made to this sector, bearing in mind that it applies to all the sectors, in this case to the actual guide vane assembly 3 in its entirety. Each sector 5 of the guide vane assembly comprises an outer shell ring 8 with a cylindrical wall 9 and an inner shell ring 10 which also has a cylindrical wall 11, said shell rings being concentric relative to the axis A and between which vanes 12 are provided through which the primary air flow F passes, coming from upstream from the fan and is directed downstream to the combustion chamber. To assist the illustration, the distance separating the axis A from the inner shell ring 10 of the guide vane assembly has been reduced. Regarding the inner shell ring, FIG. 1 shows that the outside thereof is coated in a known way with an abradable coating 25 against which a seal is applied with a plurality of lips 26 provided on the rotor stage 4.

The heads 13 and feet 14 of the vanes 12 are fixed, for example by soldering, to the walls 9 and 11 of the outer shell ring 8 and the inner shell ring 10 respectively. The vanes 12 extend over almost the entire width of the shell rings along the axis A, so that the leading edge 15 and the trailing edge 16 of the vanes in relation to the flow direction F are situated close to the end transverse faces 17 and 18, which are the front and rear (or upstream and downstream) faces respectively, of the walls 9, 11 of the cylindrical shell rings.

In addition, the means of attachment 7 to the external casing 6 are provided on the outer periphery of the side wall 9 of the outer shell ring 8 and in this example said means consist of a slide rail and slider assembly. The means of attachment 7 are therefore defined, in this first embodiment of the guide vane assembly, by two curved engagement rims, being the front or upstream 19 and rear or downstream 20 rims in relation to the direction of flow F, to form a slider, and which are engaged, as shown diagrammatically in FIG. 1, in housing and maintenance slots 21, forming a slide rail, of the external casing 6 which surrounds the sectors 5 of the guide vane assembly 1.

Figure 2:
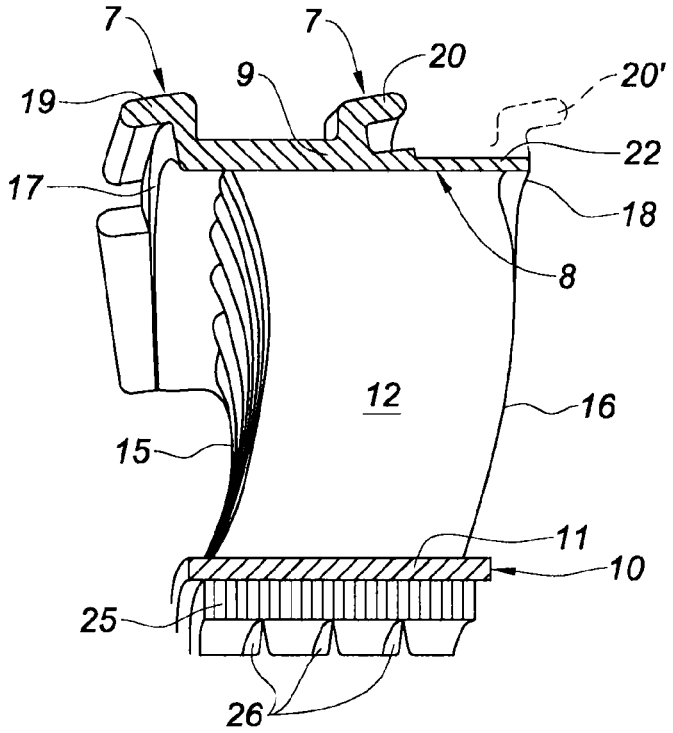
FIG. 2 is a view in partial perspective of the guide vane assembly of FIG. 1, with the rear engagement rim axially offset.
Figure 3:
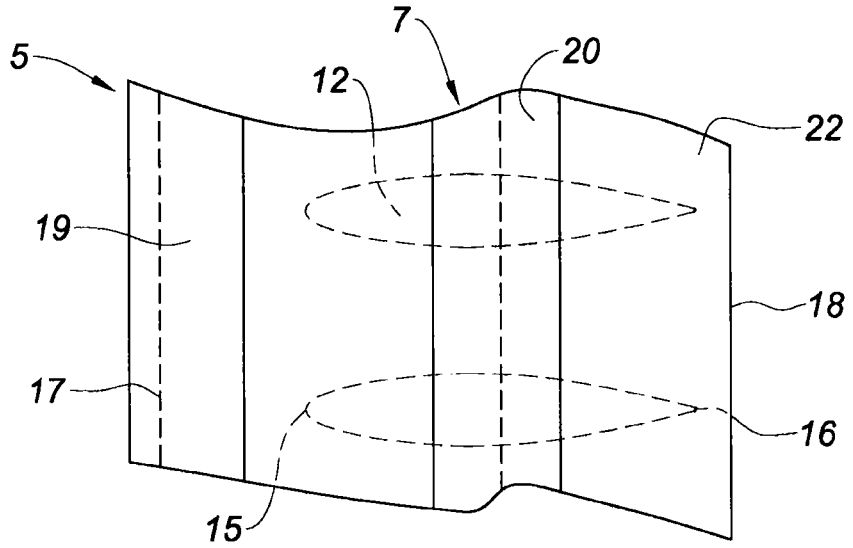
FIG. 3 is a view from above of the guide vane assembly of FIG. 2.

FIGS. 1 to 3 show that the front engagement rim 19 is situated substantially directly above the front transverse face 17 of the outer shell ring 8, whereas the rear engagement rim 20 is located according to the invention at a distance from the rear transverse face 18 of the shell ring, substantially in the centre of the cylindrical side wall 9 and, therefore, directly above the vanes 12. Dimensionally, said rear rim 20 is provided so as to be situated projecting in the centre of the vanes 12, where said vanes are thickest, as shown in FIG. 3.

By this axial offsetting of the rear rim 20 towards the front rim 19 (situated initially at the rear face 20 of the outer shell ring 20, that is, close to the trailing edge 16 of the vanes, shown in dashed lines in the illustration, reference 20' in FIG. 2) substantially as far as the centre of the side wall 9 of the outer shell ring, all the aerodynamic forces (flow F passing through the guide vane assembly) and the mechanical stresses transmitted by the external casing 6 will pass into the sectors 5 through the blend radius defined by the curved rear rim 20, and the heads 13 of the vanes, in the centre thereof, and will thus be absorbed by a greater material volume. Consequently, the maximum static stress produced by these forces on the stator will be lower.

Therefore, as the rear portion or end 22 of the side wall 9 of the outer shell ring 8 (portion 22 ending in the rear transverse face 18) is no longer subject to this maximum static stress, it can absorb a greater maximum admissible dynamic stress, because said maximum admissible dynamic stress is still located in said rear portion 22. Consequently, by separating the stresses and offsetting the maximum static stress in relation to the maximum dynamic stress, the vibratory capacity of the guide vane assembly 3 and therefore of the stator stage 2 is improved, in other words its capacity to resist a given aerodynamic excitation.

Figure 4:
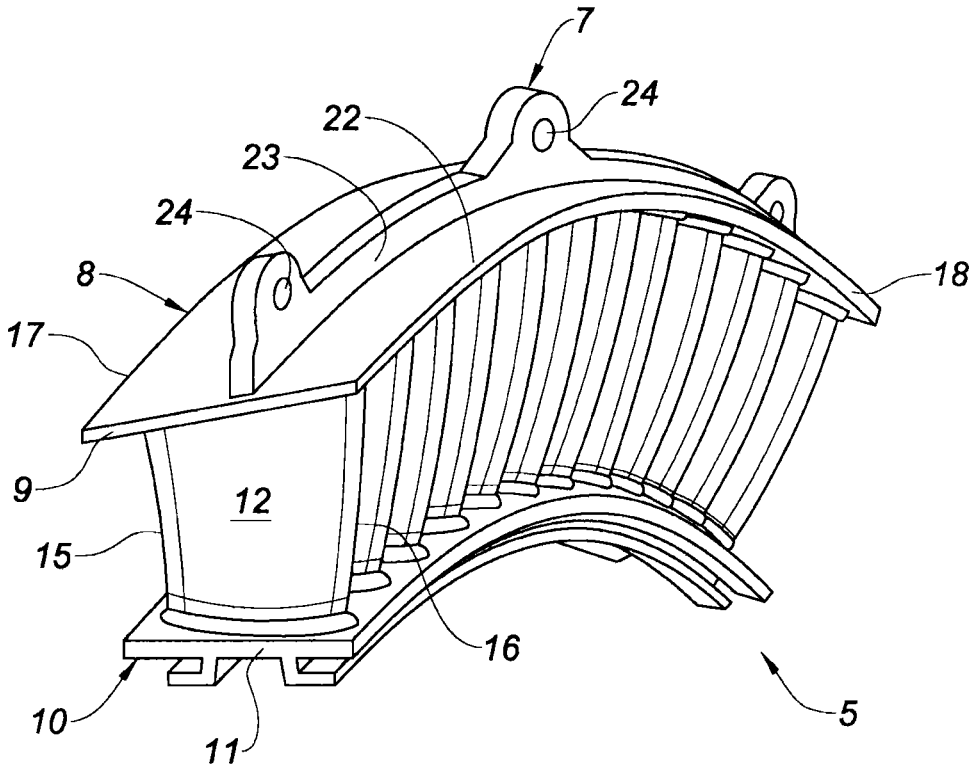
FIG. 4 is a perspective view of another embodiment of the guide vane assembly according to the invention.

Another embodiment of the sectorised guide vane assembly 3 according to the invention is shown in FIG. 4. In this perspective view of a sector 5 of the guide vane assembly, the concentric outer 8 and inner 10 shell rings respectively between which the vanes 12 are arranged can be seen. The means of attachment 7 to the external casing (not illustrated in this figure) are provided on the outside of the outer shell ring 8. These means of attachment 7, unlike in the previous embodiment, comprise a single annular flange 23 projecting radially from the side wall 9 of the cylindrical shell ring 8, which is provided at regular intervals on its periphery with holes 24 for fixing to the housing casing through which bolts or similar pass.

Advantageously, the flange 23 is arranged between the upstream 17 and downstream 18 transverse faces of the wall of the shell ring and, in particular, between the leading 15 and trailing 16 edges of the vanes being situated projecting substantially in the region of the greatest thickness thereof.

An embodiment of this type with a central flange 23 produces similar results to the previous embodiment with two engagement rims 19, 20. The static stress caused by the different forces is located in the region of the central flange 23 of the shell ring and of the thick portions of the vanes and is therefore separated from the maximum dynamic stress which is produced in the rear portion 22 (which is therefore free from static stress) of the wall 10 of the shell ring 8. Consequently, the maximum admissible dynamic stress can be increased without impairing the integrity of the guide vane assembly 3, allowing higher levels of vibration on the engine.

Moreover, the front 19 and rear 20 rims, and the flange 23, can be produced continuously or discontinuously on the periphery of the side wall 11 of said outer shell ring 8.

The invention claimed is:

1. A sectorized compressor guide vane assembly for a turbomachine, comprising:

assembled sectors that form two concentric outer and inner shell rings, said concentric outer and inner shell rings having front and rear transverse faces; and vanes arranged between the concentric outer and inner shell rings, each vane comprising a leading edge closer to the front transverse face of the outer and inner shell rings than the rear transverse face of the outer and inner shell rings and a trailing edge closer to the rear transverse face of the outer and inner shell rings than the front transverse face of the outer and inner shell rings, the outer shell ring externally includes means of attachment to an external casing for housing the sectors, wherein the means of attachment are axially offset from the rear transverse face of the outer shell ring and is configured to absorb static forces between the external casing and the guide vane assembly, the means of attachment to the external casing comprising, in relation to a direction of flow passing through the vanes, a front curved peripheral engagement rim situated at the front transverse face of the outer shell ring of the sectors, and a rear curved peripheral engagement rim offset from the rear transverse face of the outer shell ring, the rear curved peripheral engagement rim and an end portion of the rear curved peripheral engagement rim are provided so as to be situated projecting substantially in a center of the vanes between the leading and trailing edges thereof, both curved peripheral engagement rims being designed to cooperate with slots of the external casing for maintaining the guide vane assembly.

2. A guide vane assembly according to claim 1, wherein the rear curved peripheral rim extends continuously or discontinuously over all the sectors.

3. A guide vane assembly according to claim 1, wherein the center of the vanes presents a thickest portion of the vanes.

4. A sectorized compressor guide vane assembly for a turbomachine, comprising:

assembled sectors that form two concentric outer and inner shell rings, said concentric outer and inner shell rings having front and rear transverse faces; and vanes arranged between the concentric outer and inner shell rings, each vane comprising a leading edge closer to the front transverse face of the outer and inner shell rings than the rear transverse face of the outer and inner shell rings and a trailing edge closer to the rear transverse face of the outer and inner shell rings than the front transverse face of the outer and inner shell rings, the outer shell ring externally includes means of attachment to an external casing for housing the sectors, wherein the means of attachment are axially offset from the rear transverse face of the outer shell ring and is configured to absorb static forces between the external casing and the guide vane assembly, the means of attachment to the external casing comprising, in relation to a direction of flow passing through the vanes, an annular flange projecting radially from the outer shell ring, provided on a periphery of the outer shell ring and situated projecting directly above the vanes between the leading edge and trailing edge of said vanes, said annular flange being situated projecting in a center of the leading and trailing edges of the vanes, the center of the vanes presents a thickest portion of the vanes and the annular flange being situated projecting substantially in a region of said thickest portion, and said annular flange being provided at regular intervals on its periphery of the outer shell ring with holes so as to fix bolts passing through said holes and to fix to the external casing.

5. A guide vane assembly according to claim 4, wherein the annular flange has a thickness equal to at most twice a thickness of the outer shell ring.

* * * * *